United States Patent [19]

Schröder

[11] Patent Number: 4,582,173

[45] Date of Patent: Apr. 15, 1986

[54] GROUP CONTROL FOR ELEVATORS WITH DOUBLE CARS

[75] Inventor: Joris Schröder, Lucerne, Switzerland

[73] Assignee: Inventio AG, Switzerland

[21] Appl. No.: 638,262

[22] Filed: Aug. 6, 1984

[30] Foreign Application Priority Data

Aug. 12, 1983 [CH] Switzerland ..... 4410/83

[51] Int. Cl.[4] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,625,311 | 12/1971 | Nowak et al. | 187/29 |
| 4,355,705 | 10/1982 | Schröder et al. | 187/29 |
| 4,411,337 | 10/1983 | Schröder et al. | 187/29 |
| 4,448,286 | 5/1984 | Kuzunuki et al. | 187/29 |

*Primary Examiner*—William M. Shoop, Jr.
*Assistant Examiner*—W. E. Duncanson, Jr.
*Attorney, Agent, or Firm*—Marshall & Melhorn

[57] ABSTRACT

A group control for elevators in which the allocations of the individual cars of double cars in an elevator group to stored floor calls can be optimized with respect to time, and newly occurring floor calls can be assigned immediately. A computing device is provided for each elevator to calculate operating costs of each car corresponding to the waiting and delay times of passengers at the floor and aboard the car with regard to each floor. The operating costs are reduced if unidirectional calls exist on the calculation floor and on a directly adjacent floor, and/or if coincidences of car calls and such floors occur. The operating costs of the two cars of a double car are compared with one another and the smaller costs are stored in a cost memory. During a cost comparison cycle, the operating costs of all elevators are compared with one another floor by floor via a comparator, whereby an allocation instruction is stored in an allocation memory of the elevator with the smallest operating costs. The allocation instruction designates the floor to which the car is assigned optimally with respect to time.

10 Claims, 3 Drawing Figures

GROUP CONTROL FOR ELEVATORS WITH DOUBLE CARS

BACKGROUND OF THE INVENTION

1. Field of the Invention

The invention concerns a group control for elevators with double cars in which two cars are arranged in a common car frame. In particular, the elevator control includes car call memories and load weighing instruments assigned to the cars, floor call memories, selectors assigned to each elevator of the group indicating the floor of a possible stop, as well as a scanning device showing at least one position for every floor, whereby a control device is provided by means of which the double cars of the elevator group are allocatable to the floor calls.

Elevators of this type can transport twice as many passengers with every trip as do elevators with single cars. Since less stopping is necessary, the same quantity of floor calls can be served in less time, so that the carrying capacity can be increased considerably.

2. Description of the Prior Art

U.S. Pat. No. 3,625,311 discloses a control for an elevator group with double cars arranged in such a way that two adjacent floors can be served simultaneously. Thus, a building should be filled in as short as possible a time with approximately steady population of the double cars. On the ground floor the passengers going to even-numbered upper floors board the upper car, and those going to the odd-numbered upper floors board the lower car, whereby in each case the car call buttons for the floors not assigned to the car are disabled. As soon as the car must stop for a floor call, the disabling is removed, so that the person boarding can ride to a desired floor. The control of the elevator group operates according to a system of subdividing the path of travel into zones, whereby cars and zones are assigned to each other and the cars are distributed over the entire path of travel according to the location of the zones. With controls of this type, the allocation of the floor calls to the cars is solely dependent on the location and direction of the calls, whereas other factors, for example the car load, are not taken into consideration in the allocating procedure. An even distribution of passengers to the individual cars of the double cars is therefore not possible with normal operation of the elevator installation, so that optimum results are not attainable with regard to short average waiting times for passengers and to increased carrying capacity.

The allocation of the cars to the floor calls can be optimized, with respect to time, with a group control for elevators with single cars as disclosed in U.S. Pat. No. 4,355,705. A sum proportional to the time losses of waiting passengers and the time losses of the passengers in the car is calculated from the distance between the floor and the car position shown by a selector, the intermediate stops expected within this distance, and the momentary car load. The car load present in the computing time period is corrected for the probable boarders and persons getting off, derived from the numbers of persons getting on and off in the past, with respect to future intermediate stops. The calculations are performed by means of a computing device in the form of a microprocessor during a scanning cycle of each floor by a first scanner, whether a floor call is present or not. The lost time total, also called operating cost, is stored in a cost memory. During a cost comparison cycle by means of a second scanner, the operating costs of all elevators are compared with one another via a comparator device, whereby an allocation instruction is stored in an allocation memory of the elevator with the lowest operating costs. This instruction designates that floor to which the car in question is optimally assigned with respect to time.

SUMMARY OF THE INVENTION

The task underlying the present invention consists of creating a group control for elevators with double cars through the improvement of the group controls described above, by means of which the double cars are allocatable to the floor calls in such a way that minimum average waiting times for passengers are obtained and the carrying capacity of the elevators is increased. To solve this task, the invention suggests computing the operating costs for each of the two cars of a double car elevator system and comparing the costs with one another by means of a comparator circuit, whereby the lower operating costs are stored in the cost memory of the elevator in question, and whereby the operating costs to be stored are reduced in response to the existence of allocation instructions for unidirectional floor calls of at least two adjacent floors and/or coincidences of car calls and floor calls.

The advantages gained with the invention lie, in particular, in the fact that stopping at adjacent floors with unidirectional floor calls and/or at floors with car and floor calls is promoted, through which fewer stops result, the waiting times are diminished and the carrying capacity of the elevator system is raised. A further advantage is that in each case the car with the smaller operating costs serves a single, allocated floor call. In this way, the double cars are evenly filled and the carrying capacity is increased.

DETAILED DESCRIPTION OF THE PREFERRED EMBODIMENT

Figure 1:
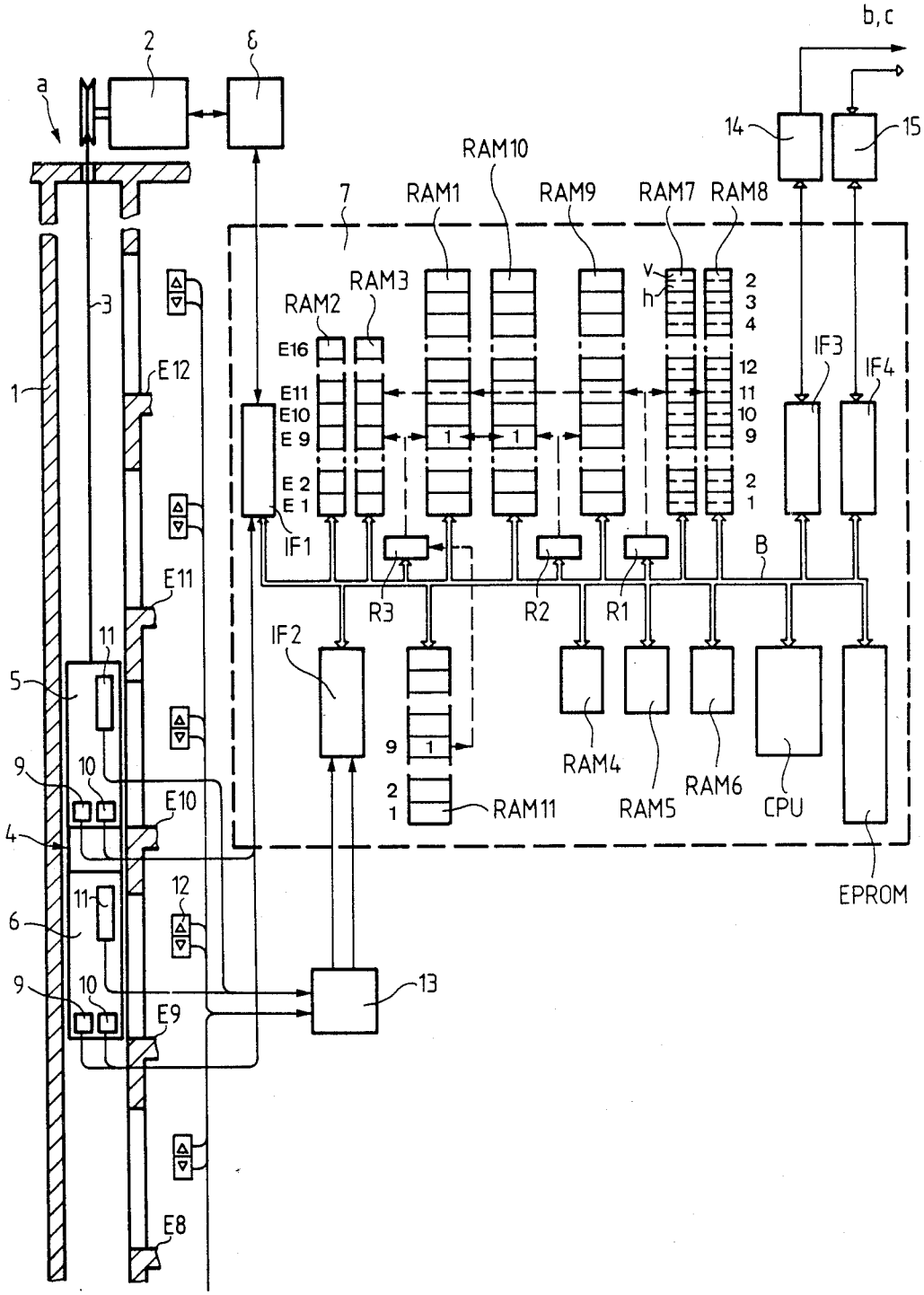
FIG. 1 is a schematic representation of a group control for elevators in accordance with the invention for one elevator of an elevator group consisting of three elevators.

In FIG. 1, an elevator shaft 1 is shown for an elevator a of an elevator group consisting of, for instance, three elevators a, b, and c. A hoist or drive unit 2 drives a double car 4 comprising two cars 5, 6 arranged in a common car frame. The cars are driven in the elevator shaft 1 via a hoisting cable 3, whereby sixteen floors E1 to E16 (only E8 through E12 are shown) are served for example. The distance between the two cars 5, 6 is chosen in such a way that it coincides with the distance between two adjacent floors. The hoist 2 is controlled by a drive control as disclosed in U.S. Pat. No. 4,337,847, whereby the step-like travel curves and displacement path reference values, the regulation or control functions and the stop-initiation signals are generated by means of a microcomputer system 7, and whereby the measuring and regulating units 8 of the drive control are connected with the microcomputer system 7 via a first interface IF1. Each car 5, 6 of the double car 4 includes a load weighing device 9, a device 10 for signalling the respective operating status Z of the car, and car call buttons 11. The devices 9 and 10 are connected with the microcomputer system 7 via the first interface IF1. The car call buttons 11 and floor call buttons 12 provided on the floors are connected to the microcomputer system 7, by way of example, via an input device 13, as disclosed in U.S. patent application Ser. No. 06/359,829, and a second interface IF2.

The microcomputer system 7 consists of a floor call memory RAM1; two car call memories RAM2, RAM3 assigned respectively to the individual cars 5, 6 of the double car 4; a load memory RAM4 storing the momentary load $P_M$ of each individual car 5, 6; two memories RAM5, RAM6 storing the operating status Z of cars 5, 6; two cost portion memories RAM7, RAM8; a cost memory RAM9; an allocation memory RAM10; a reference sign memory RAM11 for storing a reference sign for the one of cars 5, 6 with the smaller operating costs K; a program memory EPROM; and a microprocessor CPU, which is connected with the memories RAM1 to RAM11 and the EPROM via a bus B. A first and a second scanner of a scanning device are designated with R1 and R2 respectively. The scanners R1, R2 are registers in which addresses corresponding to the floor numbers and the travel direction are formed. The cost portion memories RAM7, RAM8 have two memory locations v, h for each scanner position, and are assigned to store operating costs of the cars 5, 6 of the double car 4. A selector in the form of an additional register is designated with R3, which register indicates the address of that floor at which a moving car could still stop. As is known from the above mentioned drive control, target distances are assigned to the selector addresses, which are compared with a target distance produced in a reference voltage generator. When a selector address target distance is equal to the reference target distance and a stop command exists, the deceleration phase of the elevator is initiated. If no stop command is present, the selector R3 is switched to the next floor selector address.

Figure 2:
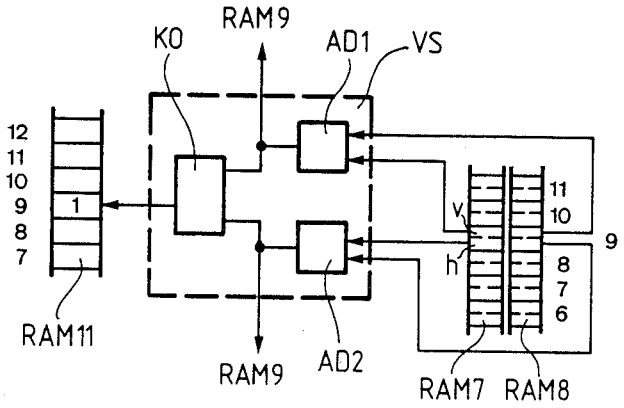
FIG. 2 is a schematic representation of a comparator circuit for an elevator of the group control according to FIG. 1.

A comparator circuit VS connected with the cost portion memories RAM7, RAM8, the cost memory RAM9 and the reference sign memory RAM11 includes, according to FIG. 2, two adders AD1, AD2 and a comparator KO. The comparator circuit VS, described in more detail below, is incorporated in the microprocessor CPU.

The microcomputer systems 7 of each of the individual elevators a, b, c are connected with one another via a comparator 14, as disclosed in U.S. patent application Ser. No. 06/312,659, and a third interface IF3 connected to the bus B. The microcomputer systems are also connected via a partyline transmission system 15, as disclosed in U.S. patent application Ser. No. 06/310,589, and a fourth interface IF4 connected to the bus B, and to form the group control in accordance with the invention.

Figure 3:
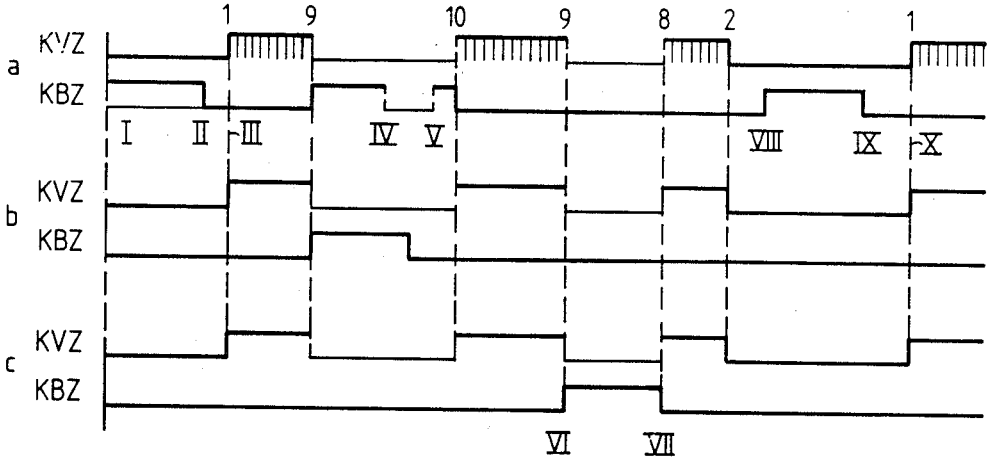
FIG. 3 is a diagram of the operating sequence, with respect to time, of the control according to FIG. 1 and FIG. 2.

With the aid of FIG. 3, the operating sequence with respect to time and the function of the group control described above is explained as follows:

When an event concerning a certain elevator a, b, c of the group occurs, as for example the input of a car call, allocation of a floor call or change in the selector position, the first scanner R1 assigned to the elevator concerned begins with a cycle, named cost calculation cycle KBZ, originating from the selector position in the travel direction of the car. If the event occurred with respect to elevator a in time period I, at each scanner position a sum proportional to the time losses of waiting passengers, also called operating costs K, is calculated by the microprocessor CPU of the microcomputer system 7 for each individual car 5, 6 of the double car 4.

The operating cost K is equal to $K_I+K_A$ where $K_I$ is the internal operating cost and $K_A$ is the external operating cost of the car as explained below. The internal operating cost is calculated from the formula $K_I=t_v(P_M+K_1 \cdot R_E-K_2 \cdot R_C)$ where $t_v$ is the deceleration time of the car with an intermediate stop, $P_M$ represents the momentary car load at the time of the calculation, $K_1$ is the presumable number of boarding persons per floor call determined in dependence on the traffic conditions, $R_E$ is the quantity of assigned floor calls between the selector position and the scanner position, $K_2$ is the presumable number of persons getting off per car call determined in dependence on the traffic conditions, and $R_C$ is the quantity of car calls between the selector position and the scanner position.

The external operating cost is calculated from the formula $K_A=K_1[m \cdot t_m+t_v(R+Z)]$ where m is the number of floor distances between the selector position and the scanner position, $t_m$ is the mean travel time per floor distance, R is the number of expected stops between the selector position and the scanner position, and Z is a quantity dependent on the operating status of the car.

The internal operating cost corresponds to the waiting time of a passenger in the car as a result of a stop on a floor designated by the scanner position. The external operating cost corresponds to the waiting time of a potential passenger on a floor designated by the scanner position. The total operating cost for the front car is calculated using the equation $K_v=S_v \cdot K_{Iv}+K_{Av}$ and the total operating cost for the rear car is calculated using the equation $K_h=S_h \cdot K_{Ih}+K_{Ah}$ wherein $K_{Iv}$ and $K_{Av}$ are the internal and external operating costs respectively for the front car in the direction of travel and $K_{Ih}$ and $K_{Ah}$ are the interal and external operating costs respectively for the rear car in the direction of travel. $S_v$ and $S_h$ are status factors for the front and rear cars respectively. $S_v$, $S_h=0$ whenever a coincidence of a car call and the scanner position exists. $S_v$, $S_h=1$ whenever an allocation instruction for unidirectional calls at two adjacent floors exists. $S_v$, $S_h=2$ whenever neither of the two previously mentioned conditions exists.

The microprocessor CPU counts allocated unidirectional calls from two adjacent floors to generate the number of expected stops R between the selector position and the scanner position. R is calculated from the equation $R=R_E+R_C-R_{EC}-R_{EE}$ wherein $R_E$ is the number of allocated floor calls between the selector and scanner positions, $R_C$ is the number of car calls between the selector and scanner positions, $R_{EC}$ is the number of coincidences of car calls and allocated floor calls between the selector and scanner positions, and $R_{EE}$ is the number of pairs of allocated unidirectional calls for two adjacent floors between the selector and scanner positions.

The factors $K_1$ and $K_2$ are determined in accordance with a group control for elevators with single cars as disclosed in U.S. Pat. No. 4,355,705. In the calculation procedure for K, the internal and external operating costs $K_{Iv}$, $K_{Av}$, $K_{Ih}$, $K_{Ah}$, are determined separately and stored in the memory locations v, h of the cost portion memories RAM7, RAM8. The total operating costs $K_v$, $K_h$, are formed for each individual car 5, 6 of the double car 4 by means of the adders AD1, AD2 of the comparator circuit VS. The costs $K_v$, $K_h$ are compared with one another and a reference sign for car 5 or car 6 is written in the reference sign memory RAM11 in accordance with the smaller operating costs. For example, the rear car, in travel direction, may produce the smaller operating costs and the rear car is marked each time by a logical "1" as shown in FIGS. 1 and 2. With the presence of the reference sign "1", the operating costs $K_h$ of the rear car are thus stored in the cost memory RAM9. Then the scanner R1 is switched to the next floor and the calculation procedure is repeated.

After finishing the cost calculation cycle KBZ (time period II), the second scanners R2 begin a cycle simultaneously for all elevators a, b, c, called cost comparison cycle KVZ, originating from the first floor (timer period III). The start of the cost comparison cycle KVZ occurs, for instance, five to ten times per second. With every scanner position, the operating costs $K_v$ or $K_h$ contained in the cost memories RAM9 of the elevators a, b, c are supplied to comparators 14 and compared with one another, whereby an allocation instruction in the form of a logical "1" is storable in each case in the allocation memory RAM10 of the elevator a, b, c with the smallest operating costs K. This allocation instruction designates that floor to which the affected elevator a, b, c is optimally assigned with respect to time.

As an example, a reallocation may result (FIG. 1), through the cancelling of an allocation instruction with elevator b and the registering of such an allocation instruction with elevator a, on the basis of the comparison in the scanner position nine. Since a floor call is stored for floor E9 and the selector R3 points to this floor (FIG. 1), the deceleration phase could be initiated with the elevator a, if the criteria previously mentioned exist. The target distance corresponding to the next following selector position is generated in response to the presence of the reference sign "1" in the reference sign memory RAMll, so that the double car 4 would stop on the floor E9 with the less loaded rear car. A new cost calculation cycle KBZ is started by the reallocation at scanner position nine and the cost comparison cycle KVZ is interrupted since the KBZ cycle has priority. While the cost calculation cycle KBZ of elevator b runs uninterrupted, the cycle of elevator a may stop between the time periods IV and V because of a drive control procedure for example. The cost comparison is subsequently continued from scanner position ten, in order to again be interrupted (time period VI) with scanner position nine (downward direction) by the occurring of an event with elevator c, for instance, a change of the selector position. After the end of the cost calculation cycle KBZ of elevator c (time period VII), continuation of the cost comparison cycle KVZ of elevator a and its termination with scanner position two (downward) results. Between the time periods VIII and IX, an additional cost calculation cycle KBZ, started for example by a car call, runs for elevator a, whereupon the next cost comparison cycle KVZ is started at the time period X.

In accordance with the provisions of the patent statutes, the principle and mode of operation of the present invention has been explained and illustrated in its preferred embodiment. However, it must be appreciated that the present invention can be practiced otherwise than as specifically explained and illustrated without departing from its spirit or scope.

What is claimed is:

1. A group control for elevators with double cars arranged in a common car frame having car call memories and load weigh instruments assigned to the cars, floor call memories, selectors assigned to each elevator of the group, in each case indicating the floor of a possible stopping, and a scanning device showing at least one position for each floor, and including a control device which has a computing device for each elevator for determining operating costs corresponding to the waiting times of passengers with each position of a first scanner of the scanning device, two cost portion memories each storing an operating cost portion of the operating costs, a cost memory storing the operating costs, a comparator for determining the car with the smallest operating costs at each position of a second scanner of the scanning device and an allocation memory whereby an allocation instruction for a present or future floor call is written into the allocation memory of the car having the smallest operating costs, the control device further comprising two memory locations in each of the cost portion memories for each scanner position for storing computed operating cost portions for each individual car of the double car, a comparator circuit connected with the cost portion memories and the cost memory for comparing the operating costs of the two cars of the double car with one another, whereby the smaller operating costs are stored in the cost memory, a reference sign memory connected with the comparator circuit and the selector for storing a reference sign for the car with the smaller operating costs, and wherein at least one of the operating cost portions stored in said cost portion memories is reduced in response to the existence of allocation instructions for unidirectional floor calls of at least two adjacent floors and/or coincidences of car calls and scanner positions of the first scanner.

2. The group control for elevators according to claim 1, whereby the computing device determines the operating costs according to the equation $K=t_v(P_M+K_1 \cdot R_E-K_2 \cdot R_C)+K_1[m \cdot t_m+t_v(R+Z)]$ in which $t_v$ is the deceleration time with an intermediate stop, $P_M$ the momentary car load at the time of the calculation, $R_E$ the quantity of assigned floor calls between selector and scanner positions, $R_C$ the quantity of car calls between selector and scanner positions, $K_1$ a presumable number of boarding persons per floor call determined in dependence on the traffic conditions, $K_2$ a presumable number of persons getting off per car call determined in dependence on the traffic conditions, m the number of floor distances between selector and scanner positions, $t_m$ the mean travel time per floor distance, R the number of expected stops between selector and scanner positions, Z an addition dependent on the operating status of the car, $t_v(P_M+K_1 \cdot R_E-K_2 \cdot R_C)$ represents the internal operating costs ($K_I$) corresponding to the waiting times of passengers presumably in the car which would originate during a stop on a floor designated by the scanner position, $K_1[m \cdot t_m+t_v(R+Z)]$ represents the external operating costs ($K_A$) corresponding to the waiting times of passengers presumably on a floor designated by the scanner position, and the determination of the operating costs $K_v$ for the front car and $K_h$ for the rear car for each individual car of the double car system with each scanner position is calculated according to the equations $K_v=S_v \cdot K_{Iv}+K_{Av}$ and $K_h=S_h \cdot K_{Ih}+K_{Ah}$ in which $K_{Iv}$ and $K_{Av}$ are the internal and external operating costs respectively of the front car in travel direction and $K_{Ih}$ and $K_{Ah}$ are the interal and external operating costs respectively of the rear car in travel direction, $S_v$ and $S_h$ are status factors, whereby $S_v$, $S_h=0$ whenever a coincidence of a car call and the scanner position exists, $S_v$, $S_h=1$ whenever an allocation instruction for unidirectional calls of two adjacent floors exists, $S_v$, $S_h=2$ whenever neither a coincidence nor an allocation instruction for unidirectional calls of two adjacent floors exists.

3. The group control for elevators according to claim 2 including a counter for counting allocated, unidirectional calls for two adjacent floors in pairs, and wherein the number of expected stops between the selector position and the scanner position is calculated according to the equation $R=R_E+R_C-R_{EC}-R_{EE}$ whereby $R_E$ represents the number of allocated floor calls between the selector and scanner positions, $R_C$ represents the number of car calls between the selector and scanner positions, $R_{EC}$ represents the number of coincidences of car calls and allocated floor calls between the selector and scanner positions, and $R_{EE}$ represents the number of pairs of allocated, unidirectional calls of two adjacent floors between the selector and scanner positions.

4. In a group control for an elevator system having a plurality of elevators with double cars including means for generating car call signals, means for generating floor call signals, a selector for indicating the floor at which each elevator car can next stop, a scanning device having first and second scanners for showing at least one position for each floor, and a control device including a computing device for determining the operating costs corresponding to the waiting times of passengers at each position of the first scanner, first and second cost portion memories for storing first and second portions of the operating costs respectively, a cost memory for storing the operating costs, a comparator for determining the car with the smallest operating costs at each position of the second scanner, and an allocation memory for storing an allocation instruction for a floor call in the allocation memory of the car having the smallest operating costs for the floor call, the control device further comprising:

a pair of memory locations associated with each scanning device position in each of the first and second cost portion memories for storing the first and second cost portions of the operating costs for each car;

a comparator circuit connected to the first and second cost portion memories and the cost memory for comparing the operating costs of the two cars in each double car elevator and storing the smaller operating costs in the cost memory; and a reference sign memory connected to said comparator circuit and to the selector for storing a reference sign for the car with the smaller operating costs which can stop at the floor of the floor call, whereby said first cost portion is reduced in value in response to the existence of allocation instructions for unidirectional floor calls of at least two adjacent floors and coincidences of car calls and scanner positions of the first scanner.

5. The group control according to claim 4 wherein the first and second cost portion memories are random access memories, said comparator circuit includes a pair of adders having inputs connected to the first and second cost portion memories and outputs connected to a comparator device, and said reference sign memory is a random access memory connected to said comparator device.

6. The group control according to claim 4 wherein the first portion of the operating costs represents the internal operating costs corresponding to the waiting times of passengers presumably in the car which would occur during a stop on a floor designed by the scanning device and the second portion of the operating costs represents the external operating costs corresponding to the waiting times of passengers presumably on a floor designated by the scanning device.

7. The group control according to claim 6 wherein the control device determines a first value for the operating costs in response to the coincidence of a car call and the scanning device position, a second value for the operating costs in response to the existence of an allocation instruction for unidirectional calls of two adjacent floors, and a third value for the operating costs in response to the absence of the conditions required for said first and second values.

8. The group control according to claim 7 wherein said first value is equal to the external operating costs of the car, said second value is equal to the sum of the internal and external operating costs of the car, and said third value is equal to the sum of two times the internal operating costs and the external operating costs of the car.

9. The group control according to claim 4 including a counter for counting allocated unidirectional calls for two adjacent floors in pairs.

10. The group control according to claim 9 wherein the computing device determines the operating costs in response to a plurality of factors including the number of expected stops between the selector position and the scanning device position and the number of expected stops includes a count total from said counter.

* * * * *